US009515426B2

(12) United States Patent
Li et al.

(10) Patent No.: US 9,515,426 B2
(45) Date of Patent: Dec. 6, 2016

(54) ELECTRICAL CONNECTOR AND COMMUNICATION DEVICE

(71) Applicant: Delta Electronics (Chen Zhou) Co., Ltd., Chen Zhou (CN)

(72) Inventors: Qing Li, Chen Zhou (CN); Wangjun He, Chen Zhou (CN); Jung-jui Wang, Chen Zhou (CN)

(73) Assignee: Delta Electronics (Chen Zhou) Co., Ltd., Chen Zhou (CN)

( * ) Notice: Subject to any disclaimer, the term of this patent is extended or adjusted under 35 U.S.C. 154(b) by 0 days.

(21) Appl. No.: 14/840,061

(22) Filed: Aug. 31, 2015

(65) Prior Publication Data

US 2016/0141813 A1 May 19, 2016

(30) Foreign Application Priority Data

Nov. 19, 2014 (CN) ..... 2014 2 0696369 U

(51) Int. Cl.
*H01R 13/717* (2006.01)
*H01R 12/72* (2011.01)
*H01R 13/66* (2006.01)
*H01R 27/02* (2006.01)

(52) U.S. Cl.
CPC ..... *H01R 13/7175* (2013.01); *H01R 12/724* (2013.01); *H01R 13/6658* (2013.01); *H01R 13/7172* (2013.01); *H01R 27/02* (2013.01)

(58) Field of Classification Search
CPC ..... H01R 13/7175; H01R 13/717
USPC ..... 439/490
See application file for complete search history.

(56) References Cited

U.S. PATENT DOCUMENTS 5,924,890 A * 7/1999 Morin ..... H01R 13/641 439/490
6,319,051 B1 * 11/2001 Chang ..... H01R 13/6641 439/488
6,699,065 B1 * 3/2004 Espenshade ..... H01R 13/641 439/490
6,776,651 B1 * 8/2004 Liu ..... H01R 13/641 439/490
6,896,542 B2 * 5/2005 Chang ..... H01R 13/6641 439/107
7,785,135 B2 * 8/2010 Wu ..... H01R 13/719 439/490
8,206,019 B2 * 6/2012 Chen ..... G02B 6/0008 362/581
8,215,982 B2 * 7/2012 Bu ..... H01R 13/518 439/490
8,636,540 B2 * 1/2014 Bu ..... H01R 13/6594 439/490

(Continued)

*Primary Examiner* — Gary Paumen
(74) *Attorney, Agent, or Firm* — Yunling Ren; Eaton & Van Winkle

(57) ABSTRACT

The disclosure provides an electrical connector and a communication device. The electrical connector includes an insulator, on which at least one docking socket and at least one module socket are provided; a housing provided outside the insulator; a plug-in module provided on the insulator; and a signal display unit, which comprises a signal display circuit board, at least one SMD (surface-mounted-device) LED electrically coupled to the signal display circuit board, and at least two connection terminals electrically coupled to the signal display circuit board used to transmit signal of the signal display unit.

9 Claims, 11 Drawing Sheets

(56) References Cited

U.S. PATENT DOCUMENTS

| | | | | |
|---|---|---|---|---|
| 2001/0039140 | A1* | 11/2001 | Fasold | H01R 13/6641<br>439/490 |
| 2008/0032546 | A1* | 2/2008 | Xuan | H01R 13/7175<br>439/490 |
| 2009/0149061 | A1* | 6/2009 | Zhang | H01R 24/64<br>439/490 |
| 2009/0186531 | A1* | 7/2009 | Hsu | H01R 13/6658<br>439/669 |
| 2014/0213100 | A1* | 7/2014 | Xuan | H01R 13/7175<br>439/490 |
| 2015/0249308 | A1* | 9/2015 | Recce | H01R 13/641<br>439/490 |

* cited by examiner

ELECTRICAL CONNECTOR AND COMMUNICATION DEVICE

CROSS REFERENCE TO RELATED APPLICATIONS

This application claims the priority to and the benefit of the Chinese patent application No. 201420696369.6, filed on Nov. 19, 2014, and entitled "Electrical Connector and Communication Device", which is incorporated herein by reference in its entirety.

TECHNICAL FIELD

The disclosure relates generally to an electrical connector mainly for signal transmission of communication data and a communication device using the same, particularly to an electrical connector provided with a signal display unit and a communication device using the same.

BACKGROUND

An electrical connector is generally used to connect electronic devices with the network or other related electronic devices.

A conventional electrical connector includes an insulator, a housing provided outside the insulator and a plug-in module. The insulator is provided with a module socket for accommodating the plug-in module and a docking socket for a user to connect with an interface. The plug-in module includes a base, a PCB unit provided in the base and an output terminal. In order to display connection state of the user's connection interface and the docking socket of the electrical connector, some electrical connectors are provided with a signal display unit.

As shown in FIG. 1A, a conventional LED 100 includes an illuminant 110 and pins 120 connected to the illuminant 110, wherein the pins 120 of the LED 100 are in a shape of straight line.

As shown in FIG. 1B, in the conventional electrical connector, the signal display unit is generally fabricated with the conventional LED 100. In order to install the signal display unit to a proper place of the electrical connector, it is conventional to bend the straight-line-shaped pins 120 of the LED 100 into a desired shape manually with a bending tool, and a bending LED 200 with bent pins 220 is achieved. The illuminant 210 of the bending LED 200 is identical to the illuminant 110 of the LED 100.

The process for manufacturing the electrical connector includes the steps of inserting the plug-in module having a function of filtering wave into the module socket of the insulator; installing the above bending LED 200 onto the insulator; gluing the LED 200 to the insulator; and then placing the insulator on the tool of LED cutting pins manually so that the pins are cut into desired length; and finally, assembling a shell outside the insulator, thereby the electrical connector is formed.

The conventional electrical connector has following disadvantages:

Firstly, the signal display unit is manually manufactured by means of special tools, which will inevitably make the process complicated, the operation difficult, and the ineffectiveness low.

Secondly, for the electrical connectors with different structure, the LED with different pins in shape has to be used, and different bending tools are required to be equipped for the bending operation. However, the bending tools are costly and difficult for automatic production.

Thirdly, the quality of the LED is not stable when the pins thereof are bent. For example, the pins tend to be broken out, and the LED is poorly contacted and so on.

The foresaid information as disclosed in the background art only serves to enhance understanding of the background of the disclosure, thereby it may contains information not to constitute the prior art as known by those skilled in the art.

SUMMARY

An aspect of the present disclosure may help overcome at least one deficiency of the prior art, and provide an electrical connector which is simplify the manufacture process.

Another aspect of the present disclosure may help provide a communication device including the present electrical connector.

Additional aspects and advantages of the disclosure will in part set forth in the description below, and in part will become obvious from the description, or may be learned from practice of the present disclosure.

According to one aspect of the disclosure, an electrical connector includes an insulator, on which at least one docking socket and at least one module socket are provided; a housing provided outside the insulator; a plug-in module provided on the insulator; and a signal display unit, which includes a signal display circuit board, at least one SMD (surface-mounted-device) LED electrically coupled to the signal display circuit board, and at least two connection terminals electrically coupled to the signal display circuit board used to transmit signal of the signal display unit.

According to another aspect of the disclosure, a communication device includes the present electrical connector.

In the electrical connector of the disclosure, the signal display unit includes a signal display circuit board, at least one SMD LED electrically coupled to the signal display circuit board, and a connection terminal used to transmit signal of the signal display unit electrically coupled to the signal display circuit board. Thereby, in the present disclosure, when the signal display unit is manufactured, it is only required to paste the SMD LED onto the signal display circuit board, and then connect to the exterior circuit board via the connection terminal. In the process of manufacturing the signal display unit, it is not required to fix the LED by the way of applying glue, nor to bend the pins of LED by using the bending tool, or even to cut pins, thereby the process for manufacturing the signal display unit and therefore the process for producing the electrical connector are simplified, the labor strength is reduced, the work efficiency is improved. The present electrical connector may be suitable for automatic mass-production, and the quality of the products as produced is stable.

BRIEF DESCRIPTION OF THE DRAWINGS

The above and other features and advantages of the present disclosure will become more apparent from the detailed description of exemplary embodiments thereof with reference to accompany drawings.

DETAILED DESCRIPTION

Now, the exemplary embodiments will be described more fully with reference to the accompany drawings. However, the exemplary embodiments can be implemented in various forms and should not be construed as limited to the embodiments set forth herein. Instead, these embodiments are provided so that this disclosure will be thorough and complete, and the concept of the exemplary embodiment will fully conveyed to those skilled in the art. Same reference signs denote the same or similar structures in the accompany drawings, and thus the detailed description thereof will be omitted.

A First Embodiment of an Electrical Connector

Figure 1A:
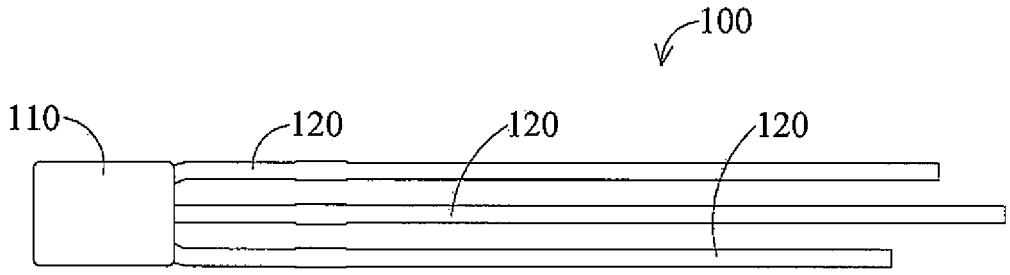
Fig.1A (Prior art)
FIG. 1A is a schematic view of a conventional LED.
Figure 1B:
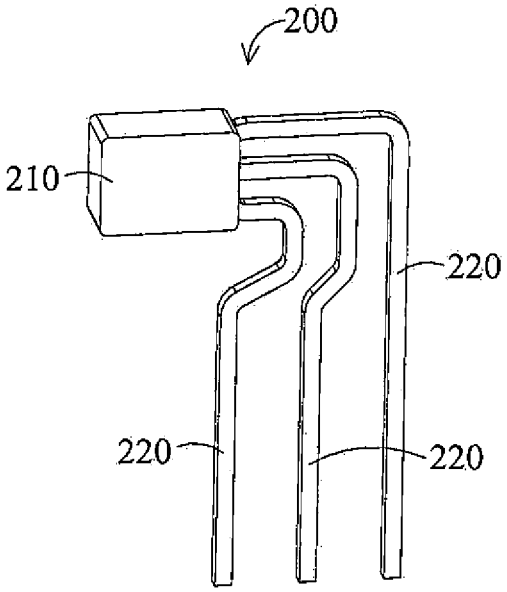
Fig.1B (Prior art)
FIG. 1B is a schematic view showing that the conventional LED bends pins in order to be used in an electrical connector.
Figure 2:
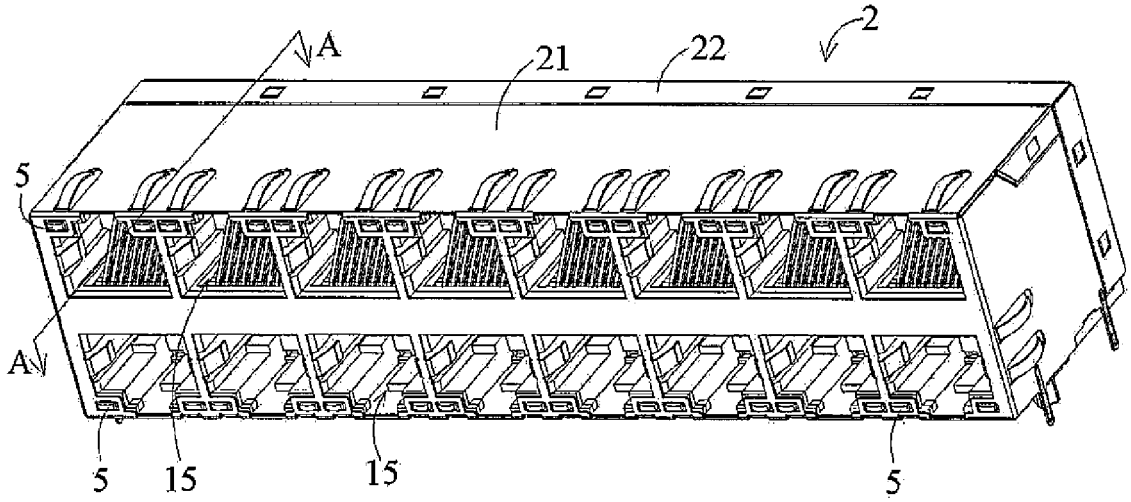
FIG. 2 is a schematic view of a first embodiment of the electrical connector according to the disclosure.
Figure 3:
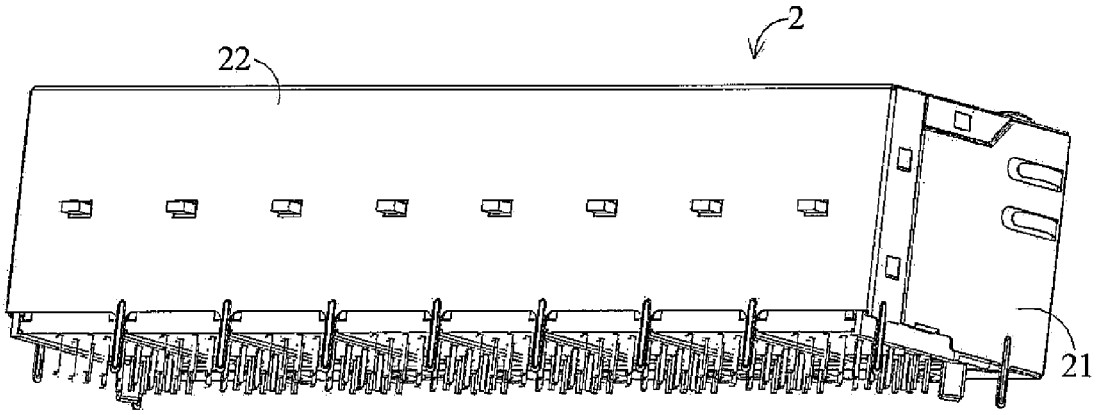
FIG. 3 is another schematic view of the first embodiment of the electrical connector according to the disclosure.
Figure 4:
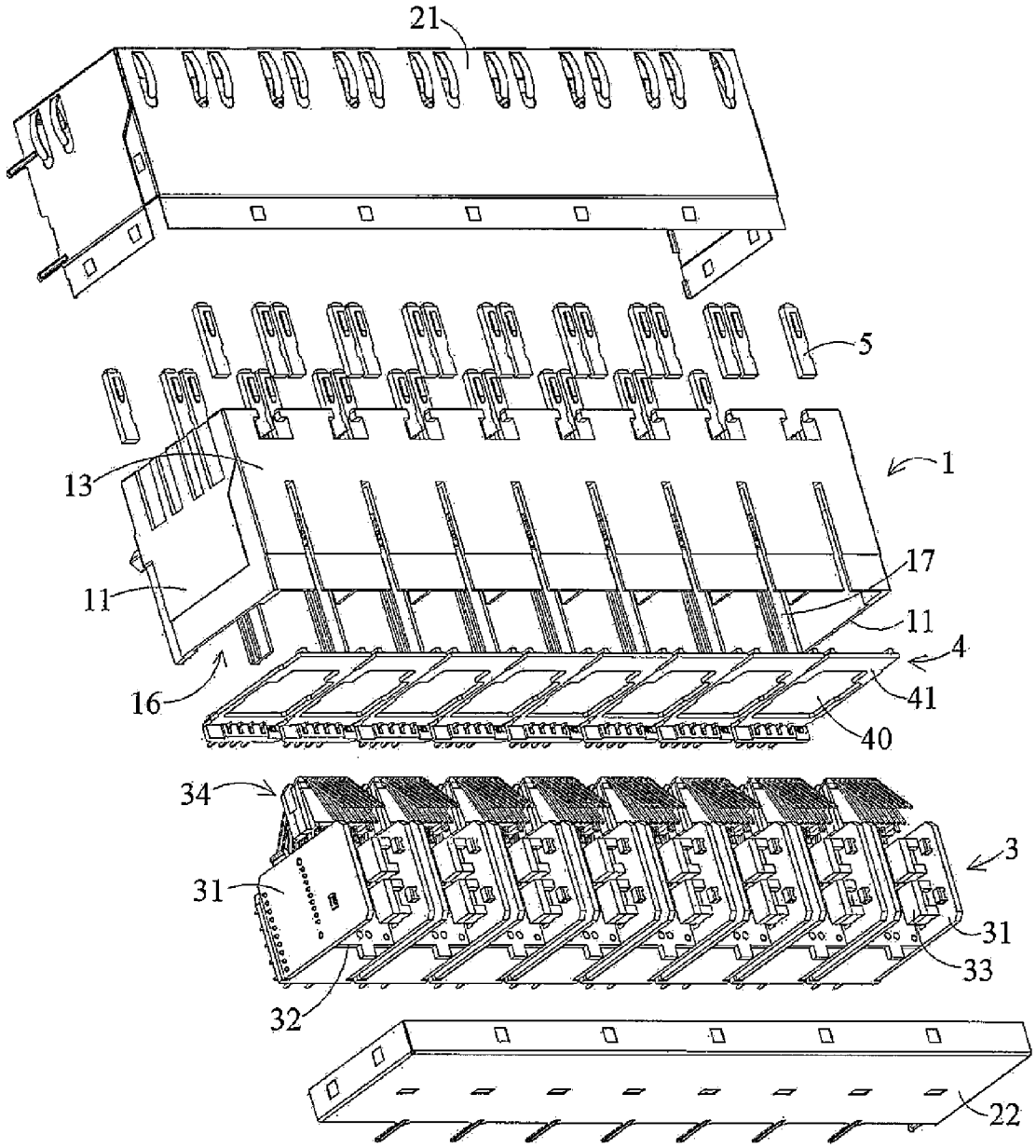
FIG. 4 is a schematic exploded view of the first embodiment of the electrical connector according to the disclosure.

With reference to FIG. 2, FIG. 3 and FIG. 4, an electrical connector according to the first embodiment of the disclosure may include an insulator 1, a housing 2, a plug-in module 3, a signal display unit 4, and a light guide pillar 5, but the invention is not limited to this.

With reference to FIGS. 2 and 3, the housing 2 of various choices of structures is provided outside the insulator 1, in the first embodiment, the housing 2 may include a housing body 21 and a rear end shell 22 connected with each other by means of, for example, snap-fits.

Figure 8:
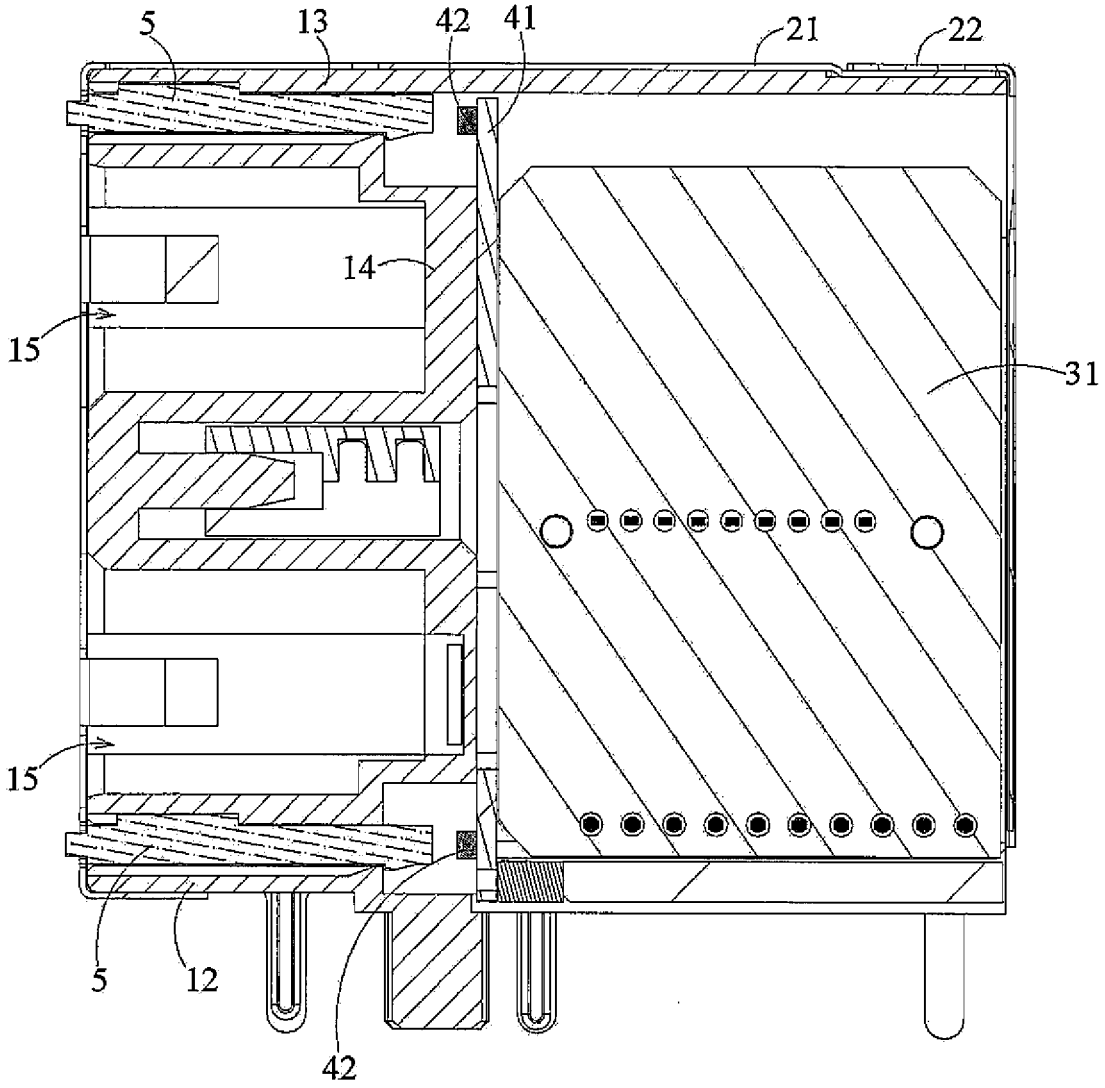
FIG. 8 is a sectional view of the electrical connector exploded along A-A as shown in FIG. 2.

With reference to FIG. 2, FIG. 4 and FIG. 8, the insulator 1 may include two side walls 11 opposite to each other, a bottom wall 12 and a top wall 13 opposite to each other (as shown in FIG. 8), a rear wall 14 (as shown in FIG. 8), and seven space walls 17 provided between the two side walls 11. In this way, the side walls 11 or the space walls 17, the bottom wall 12, the top wall 13 and the rear wall 14 are enclosed to form a plurality of docking sockets 15 each having an opening forward. The two side walls 11, the top wall 13 and the space walls 17 may extend backwardly to be enclosed with the rear wall 14 to form a plurality of module sockets 16 each having an opening backward. There may be a gap between the bottom end portion of the rear wall 14 and the bottom wall 12. The rear wall 14 may be provided with a plurality of through holes. Two receiving grooves may be provided on opposite sides of the top wall 13 over the docking socket 15, or/and two receiving grooves may be provided on opposite sides of the bottom wall 12 under the docking socket 15, but the invention is not limited to this. The receiving groove may be provided with a holding structure, such as a fixing protrusion, and so on.

In the first embodiment, the insulator 1 has eight module sockets 16 and eight docking sockets 15. In other embodiments, number of the module sockets and the docking sockets is not limited to eight, and may be increased or decreased according to the actual requirements, for example, in case that the insulator 1 only has one module socket 16, there is not required to provide the space wall 17. In other embodiments, the plurality of module sockets 16 and the plurality of docking sockets 15 of the electrical connector are not limited to one row, but may be several rows, for example, 2*N structure, 4*N structure and so on. This disclosure is not limited thereto.

With reference to FIG. 4, module sockets 16 of the insulator 1 may be provided with a plug-in module 3. The plug-in module 3 may include two vertical input circuit boards 31 disposed opposite to each other, a horizontal output circuit board 32 perpendicularly fixed between the two input circuit boards 31, a SMD transformer 33 fixed and electrically coupled to the vertical input circuit board 31 and an output terminal 34 fixed and electrically coupled to the horizontal output circuit board 32 and protruding forwardly. In other embodiments, the plug-in module may have other structures. This disclosure is not limited thereto.

Figure 5:
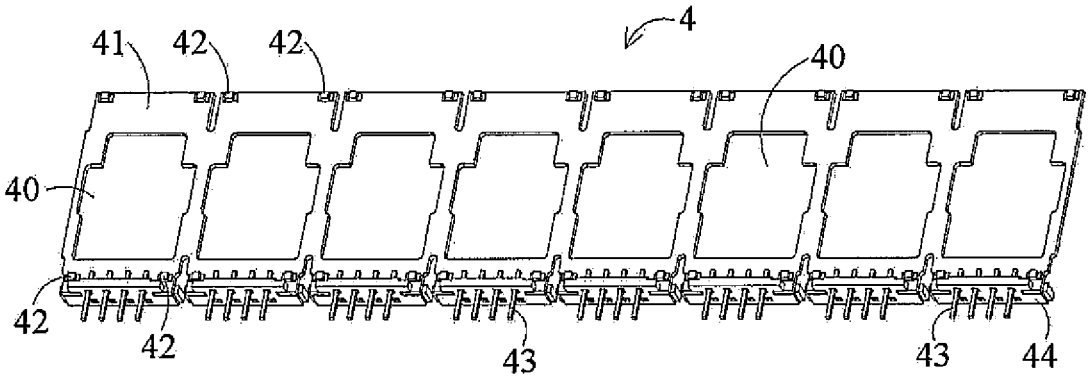
FIG. 5 is a schematic view of the signal display unit of the first embodiment of the electrical connector according to the disclosure.
Figure 6:
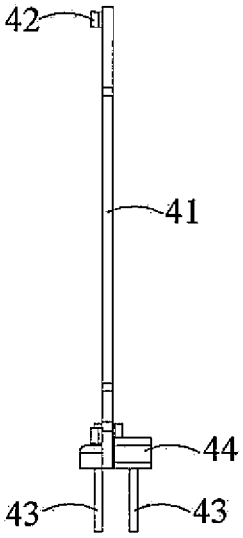
FIG. 6 is a right view of FIG. 5.
Figure 7:
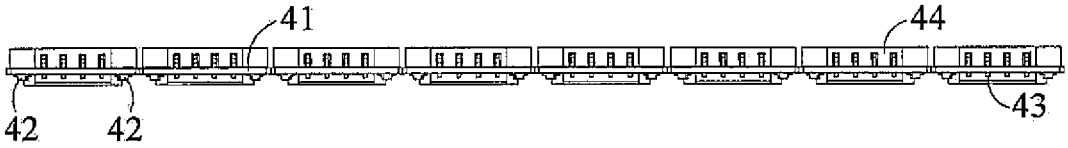
FIG. 7 is a top view of FIG. 5.

With reference to FIG. 5, FIG. 6 and FIG. 7, a signal display unit 4 may include a signal display circuit board 41, at least one SMD LED 42 and at least two connection terminals 43.

In this embodiment, the signal display circuit board 41 may have eight windows 40 and thirty-two SMD LEDs 42, and the eight windows 40 are disposed in correspondence with the eight module sockets 16 one by one. The SMD LEDs 42 are electrically coupled to the signal display circuit board 41. The SMD LEDs 42 may be provided on the signal display circuit board 41 and located on both sides of the upper portion and the lower portion of each window 40, but the invention is not limited to this. In other embodiments, the number of the windows 40 is not limit to eight, and may be as same as the number of the module socket 16 on the insulator 1. The SMD LEDs 42 may be only provided on both sides of the upper portion of the window 40, or on both sides of the lower portion of the window 40, and the SMD LEDs 42 may be also positioned on the other places. This disclosure is not limited thereto.

The signal display circuit board 41 is electrically coupled with connection terminals 43 for transmitting signal of the signal display unit 4. These connection terminals 43 may be set on any place of the signal display circuit board 41, for example, set on the bottom end portion of the signal display circuit board 41. In the first embodiment, the signal display unit 4 may further include a terminal seat 44 which may be a flat plate or an L-shaped plate or a T-shaped plate, etc. The disclosure is not limited thereto. The terminal seat 44 may be perpendicularly fixed and electrically coupled to the signal display circuit board 41, and the connection terminals 43 are fixed and electrically coupled to the terminal seat 44. For example, sixty-four connection terminals 43 may be divided into two rows on the terminal seat 44, and are provided on the front and rear sides of the signal display circuit board 41 and may be symmetrical to the signal display circuit board. Of course, in the other embodiments, the type and the number of the connection terminals 43 may be varied, the disclosure is not limited thereto.

With reference to FIG. 8, in the first embodiment, the signal display unit 4 is provided in the insulator 1 and positioned behind the docking socket 15. Specifically, the signal display circuit board 41 of the signal display unit 4 may be provided between the rear wall 14 of the insulator 1 and the vertical input circuit board 31 of the plug-in module 3, and the SMD LED 42 corresponds to the receiving groove on the insulator 1. The signal display unit 4 may be provided on the other places of the insulator 1 in the other manners, for example, being pasted on the rear wall 14 of the insulator 1. The disclosure is not limited thereto.

With reference to FIG. 2 and FIG. 4, the electrical connector may be also provided with a light guide pillar 5, and the number of the light guide pillar 5 may be as much as that of the SMD LEDs 42 of the signal display unit 4, but the invention is not limited to this. In the first embodiment, there are thirty two light guide pillars 5, which are respectively accommodated and fixed in the receiving grooves of the insulator 1. The light guide pillar 5 guides the light emitted from the SMD LEDs 42 to the front end of the insulator 1 in order to facilitate observation.

A Second Embodiment of an Electrical Connector

Figure 9:
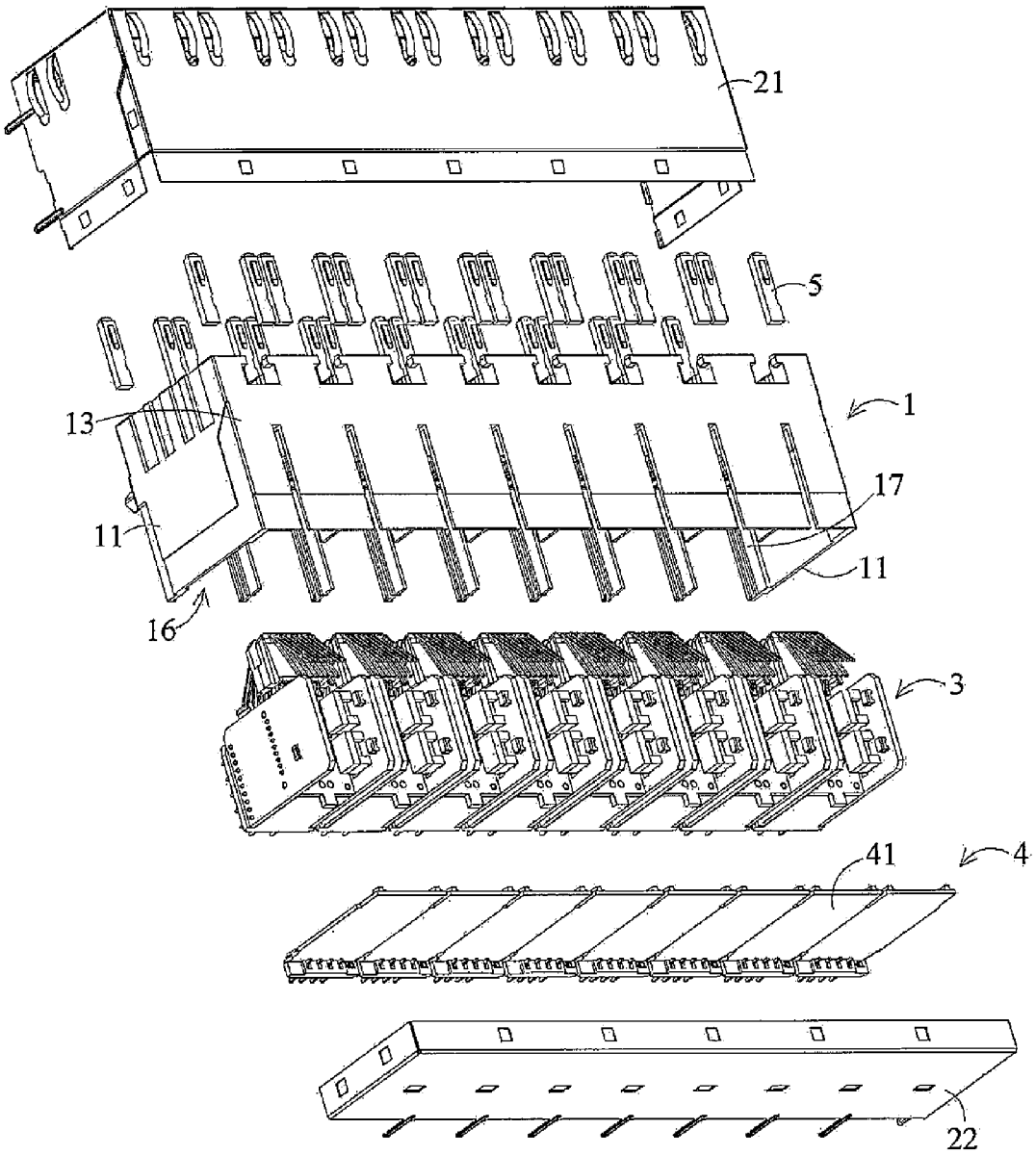
FIG. 9 is a schematic exploded view of a second embodiment of the electrical connector according to the disclosure.

With reference to FIG. 9, the differences between the second embodiment and the first embodiment of the electrical connector according to the disclosure are presented as follows:

The signal display unit 4 is provided behind the plug-in module 3, namely positioned between the plug-in module 3 and the rear end shell 22. Under such circumstance, the light guide pillar 5 extends backwardly to receive light emitted from the SMD LED 42 of the signal display unit 4. It is not necessary to provide a window 40 on the signal display circuit board 41 of the signal display unit 4.

The other structures in the second embodiment are the same as that in the first embodiment of the electrical connector, and will be omitted herein.

A Third Embodiment of an Electric Connector

Figure 10:
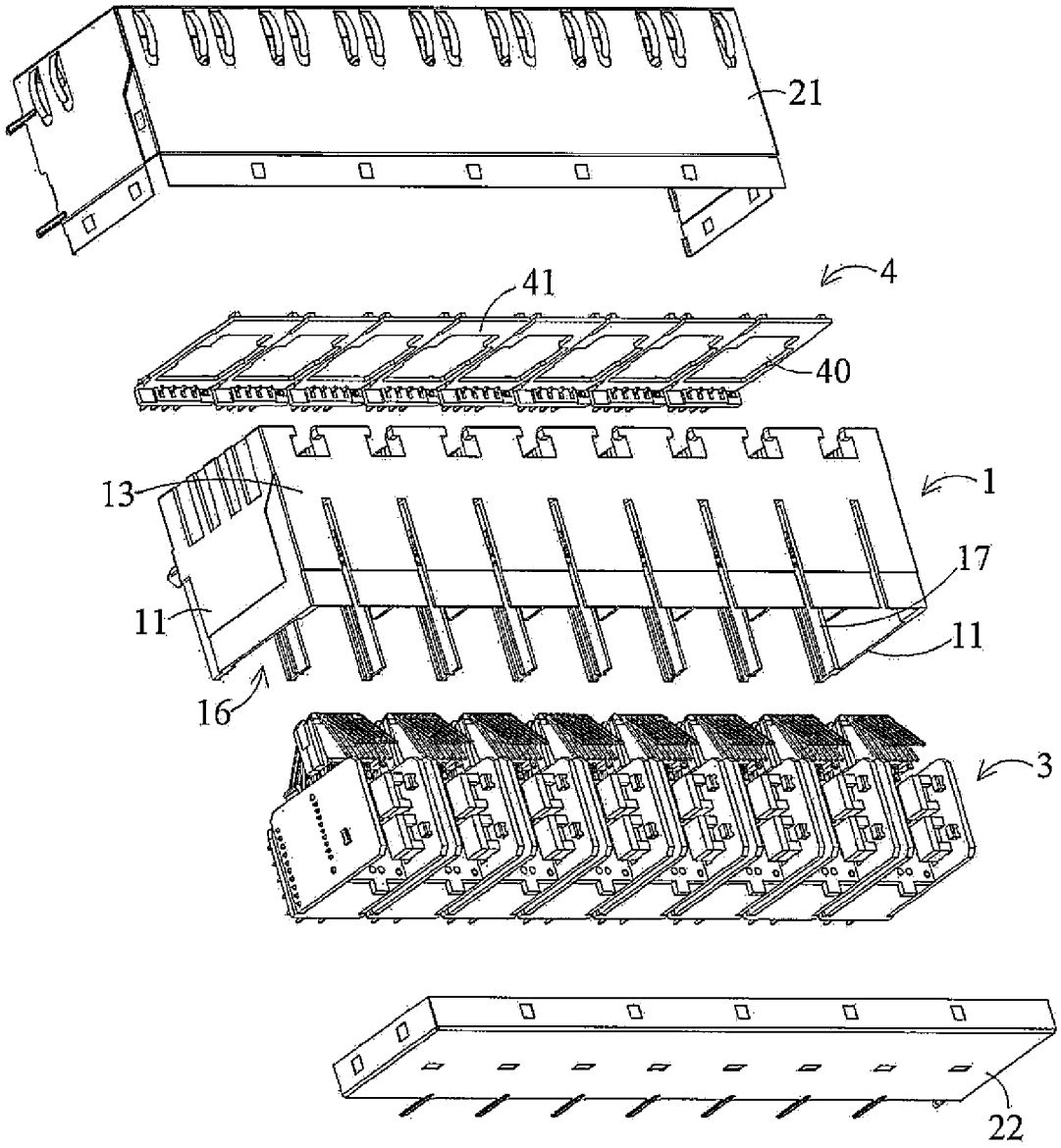
FIG. 10 is a schematic exploded view of a third embodiment of the electrical connector according to the disclosure.

With reference to FIG. 10, the differences between the third embodiment and the first embodiment of the electrical connector according to the disclosure are presented as follows:

The signal display unit 4 is provided in front of the insulator 1, for example, may be pasted and fixed onto the front end surface of the insulator 1. Under such circumstance, it is not necessary to provide the light guide pillar 5, and it is accordingly not necessary to provide the receiving groove for fixing the light guide pillar 5 on the top wall 13 or the bottom wall 12 of the insulator 1.

The other structures in the third embodiment are the same as that in the first embodiment of the electrical connector, and will be omitted herein.

An Embodiment of a Communication Device

The communication device according to the disclosure includes the present electrical connector. The communication device may be, for example, a computer, a mobile terminal, an exchanger and a router, etc.

The exemplary embodiments of the present disclosure have been illustrated and described above. It should be understood that, the present disclosure is not limited to the disclosed embodiments. On the contrary, the present disclosure intends to cover various modifications and equivalent arrangements within the spirit and the scope of the appended claims.

What is claimed is:

1. An electrical connector, comprising:

an insulator, on which at least one docking socket and at least one module socket are provided;

a housing provided outside the insulator;

a plug-in module provided on the insulator; and a signal display unit, comprising:

a signal display circuit board, which has a shape of a plane and is provided with at least one window corresponding to the at least one docking socket or the at least one module socket respectively;

at least one SMD LED electrically coupled to the signal display circuit board; and at least two connection terminals electrically coupled to the signal display circuit board used to transmit signal of the signal display unit.

2. The electrical connector according to claim 1, characterized in that the connection terminals are provided on a bottom end portion of the signal display circuit board.

3. The electrical connector according to claim 1, characterized in that the signal display unit further comprises:

a terminal seat fixed and electrically coupled to a bottom end portion of the signal display circuit board, the connection terminals are fixed and electrically coupled to the terminal seat.

4. The electrical connector according to claim 3, characterized in that the terminal seat is perpendicular to the signal display circuit board, the at least two connection terminals are respectively positioned on both sides of the terminal seat, which are symmetrical to the signal display circuit board.

5. The electrical connector according to claim 1, characterized in that the electrical connector further comprises at least one light guide pillar.

6. The electrical connector according to claim 1, characterized in that the signal display circuit board is provided in front of the insulator.

7. The electrical connector according to claim 1, characterized in that the signal display circuit board is provided behind the insulator, wherein the insulator is provided with a light guide pillar used to guide light emitted by the SMD LED to a front end of the insulator.

8. The electrical connector according to claim 1, characterized in that the signal display circuit board is provided inside the insulator and positioned behind the docking socket, and the insulator is provided with a light guide pillar used to guide the light emitted from the SMD LED to a front end of the insulator.

9. A communication device, comprising at least one electrical connector according to claim 1.

* * * * *